US007771795B2

(12) United States Patent
Juers et al.

(10) Patent No.: US 7,771,795 B2
(45) Date of Patent: Aug. 10, 2010

(54) POWDER COATINGS AND METHODS OF FORMING POWDER COATINGS

(75) Inventors: David H. Juers, Cape Elizabeth, ME (US); Craig R. Libby, Gorham, ME (US); Todd M. Roper, Cranberry Township, PA (US); Michael J. Tripp, Standish, ME (US)

(73) Assignee: S.D. Warren Company, Boston, MA (US)

( * ) Notice: Subject to any disclaimer, the term of this patent is extended or adjusted under 35 U.S.C. 154(b) by 241 days.

(21) Appl. No.: 11/839,163

(22) Filed: Aug. 15, 2007

(65) Prior Publication Data

US 2009/0047480 A1 Feb. 19, 2009

(51) Int. Cl.
*B05D 3/06* (2006.01)
*B05D 3/12* (2006.01)

(52) U.S. Cl. ..... 427/521; 427/202; 427/369

(58) Field of Classification Search ..... 427/521, 427/202, 369
See application file for complete search history.

(56) References Cited

U.S. PATENT DOCUMENTS 3,682,738 A 8/1972 Smith
6,238,750 B1 * 5/2001 Correll et al. ..... 427/521
6,635,202 B1 * 10/2003 Bugg et al. ..... 264/45.1
7,018,680 B2 3/2006 Käsmä et al. ..... 427/471
2004/0142181 A1 7/2004 Marsella et al.
2005/0123678 A1 6/2005 Maijala et al.

FOREIGN PATENT DOCUMENTS

WO WO03/076083 9/2003
WO WO03/076716 9/2003
WO WO03/077371 9/2003

OTHER PUBLICATIONS

European Search Report in related application 08161110.5-1215/2025413 dated Nov. 30, 2009.

* cited by examiner

*Primary Examiner*—Frederick J Parker
(74) *Attorney, Agent, or Firm*—Fish & Richardson P.C.

(57) ABSTRACT

Methods for applying and curing powder coatings, and for imparting a surface effect, e.g., texture or smoothness, to powder coated surfaces are provided. Preferred methods include pressing a textured release medium against the uncured powder coating and then curing the coating to form a thermally stable powder coating surface with the negative image of the texture on the release medium on its surface.

21 Claims, 6 Drawing Sheets

POWDER COATINGS AND METHODS OF FORMING POWDER COATINGS

TECHNICAL FIELD

This invention relates to processes for forming powder coatings, some of which include surface effects, and to products including such coatings.

BACKGROUND

Powder coating technology involves applying a coating of a thermoplastic or thermoset powder, for example a polyamide, polyester, polyolefin, urethane, acrylic, fluoropolymer or epoxy system, to a substrate and forming a continuous film through coalescence of the powder particles at temperatures greater than the powder melting point. In the case of thermoset chemistries, the powder is also cured/polymerized during the coalescence phase. Generally curing/polymerization of thermoset powders is initiated thermally or by exposure to radiation, e.g., with ultraviolet (UV) light.

In some cases, it is desirable to apply a surface texture to the coating, such that the cured coating will be textured. U.S. Pat. No. 6,238,750 discloses techniques that are said to impart smoothness or texture to a powder coated surface by compressing the surface with a "flexible confining membrane" or "an engraved or etched photolithographic pattern on the pressing surface." Some commercial processes impart a crude texture to powdered coatings by manipulating the coating formulation, for example by using powders having various particle sizes and melting temperatures in the powder coating formulation.

SUMMARY

Methods for applying and curing powder coatings, and for imparting a surface effect, e.g., texture or smoothness, to powder coated surfaces are provided. Some preferred methods include pressing a textured release medium against the uncured powder coating and then curing the coating to form a thermally stable powder coating surface with the negative image of the texture on the release medium on its surface.

The present disclosure features methods and systems which allow a surface effect, e.g., a smooth high gloss or low gloss surface or a surface texture to be imparted to a powdered coating with very high fidelity. In some preferred processes, the desired surface effect is replicated in the surface of the powder coating with substantially 100% fidelity. Very fine and/or intricate textures may be imparted. As used herein, the terms "texture" and "textured surface" include very fine microtextures, e.g., including textures having a topography below the wavelength of light. Surface effects include very high gloss surfaces and low gloss surfaces, which appear smooth to the naked eye but may include a microtexture in order to achieve the desired surface effect. The textures discussed herein are predetermined textures, i.e., textures that are intentionally imparted to a surface rather than merely the texture that is inherently present on any surface due to the natural topography of the surface, surface contamination, and the like.

The present disclosure also features methods of forming functional powder coatings using a release medium, e.g., a release sheet or web, to transfer the powder coating to a substrate. In some cases the resulting cured powder coating may not include any predetermined surface effect, in which case the release sheet is used simply to transfer the powder coating rather than to impart a surface texture.

In one aspect, the invention features a method of powder coating a substrate comprising: (a) applying an uncured powder coating formulation to a substrate to form an uncured coating layer; (b) imparting a texture to the uncured coating layer using a release medium bearing a replicative surface; (c) curing the coating; and (d) stripping the release medium from the coated surface.

Some implementations may include one or more of the following features. The texture may be imparted in a press, and in some cases the coating may also be cured in the press. The coating may be thermally cured and/or radiation cured. Alternatively, the texture may be imparted in a press, the textured coated substrate then removed from the press, and the textured coating cured at a radiation curing station. The release medium may be stripped from the textured surface prior to or after curing. The release medium may comprise a release film or release paper. The method may include providing the release medium by applying a curable release coating to a flexible web, imparting a texture to the coating and curing the coating to form a surface layer. In this case, the texture may be imparted to the coating on the flexible web using a roll engraved with a replicative pattern. The method may further include tip printing the release medium prior to imparting the texture to the uncured powder coating. The release medium may be in the form of a sheet or web.

In another aspect, the invention features a method of powder coating a substrate comprising: (a) applying an uncured powder coating formulation to a release medium; (b) contacting an exposed surface of the uncured powder coating formulation with a substrate to be coated, applying sufficient pressure so that the powder coating adheres to the substrate; (c) curing the coating; and (d) stripping the release medium from the cured powder coating. Thus, in this aspect, the release medium is used as a transfer medium to apply the powder coating to the substrate. In some cases, the release medium also includes a texture which is imparted to the powder coating.

Some implementations may include any of the features discussed above.

The invention also features powder coated products, for example the invention features an intermediate product comprising a substrate, a powder coating on a surface of the substrate, and a textured release medium disposed on a surface of the powder coating such that the powder coating is interposed between the substrate and the release medium. The release medium may comprise a sheet or web.

In another aspect, the invention features caul plates, for use in manufacturing processes, having a powder coated surface. For example, the invention features a caul plate comprising a caul plate body, and, on a surface of the body, a layer of a cured powder coating having a release surface. The release surface generally includes a texture to define a replicative surface.

The details of one or more embodiments of the invention are set forth in the accompanying drawings and the description below. Other features and advantages of the invention will be apparent from the description and drawings, and from the claims.

DETAILED DESCRIPTION

Figure 1:
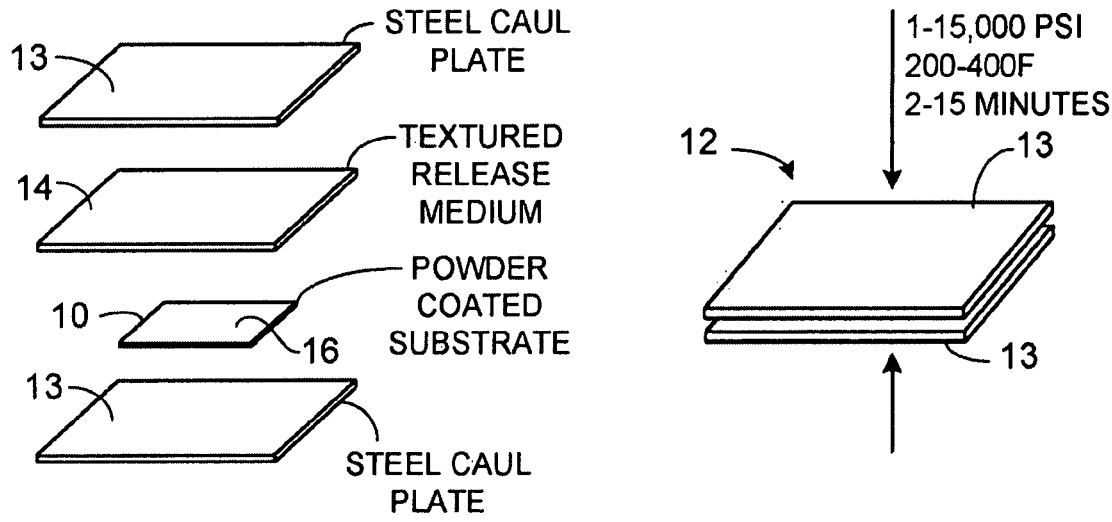
FIG. 1 is a diagrammatic view showing a process for texturing a powder coating, in which the powder coating is cured in a press.

Referring to FIG. 1, to impart a texture to a powder coated substrate 10, the powder coated substrate, carrying an uncured powder coating, is placed in a low pressure panel press 12 that includes a pair of steel caul plates 13. Prior to placing the substrate in the press, it is generally desirable to soften/melt the powder to form a film. Depending on the temperature, pressure, powder melt viscosity, and powder reactivity, the powder can be in either a completely uncured form when the substrate is pressed or it may be helpful to partially cure the powder prior to pressing. For optimal temperature control, it is generally preferred that an oven be used for the partial curing step. However, if desired, any heat source (e.g., platen, oven, or infrared (IR) heater) may be used to induce partial cure. Once the substrate and powder coating have been prepared in this manner, a release medium 14 is pressed against the surface 16 of the powder coating and the resulting "sandwich" is placed in the press 12. The release medium 14 may be, for example, a release paper or release film having a replicative surface. Preferred methods for manufacturing the release medium will be described below. Advantageously, because release functionality is built into the release medium, it is generally not necessary to modify the powder coating formulation to have release properties, or to use a mold release agent which could transfer to the powder coating surface.

The press is then closed, and heat and pressure are applied to the "sandwich" of release medium and powder coated substrate to cure the powder coating. The temperature applied in the press, and the press dwell time, are dependent upon the curing characteristics of the powder coating, but should be sufficient to cure the coating while the release medium 14 is in contact with surface 16. Curing schedules for some conventional powder coating formulations are in the range of 200 to 400° F. for 2 to 15 minutes. The press pressure is dependent on the powder melt viscosity and is specific to the texture depth. If other factors are kept constant, a shallow texture requires less pressure than a deep texture. The pressure is preferably relatively low, e.g., between 1 and 15,000 psi, more preferably between 5-700 psi. Once the powder has cured, the release medium may be stripped from the cured coating immediately, or the release medium may be left in place and stripped at a later time if desired. The release medium can generally be reused, if desired.

Figure 2:
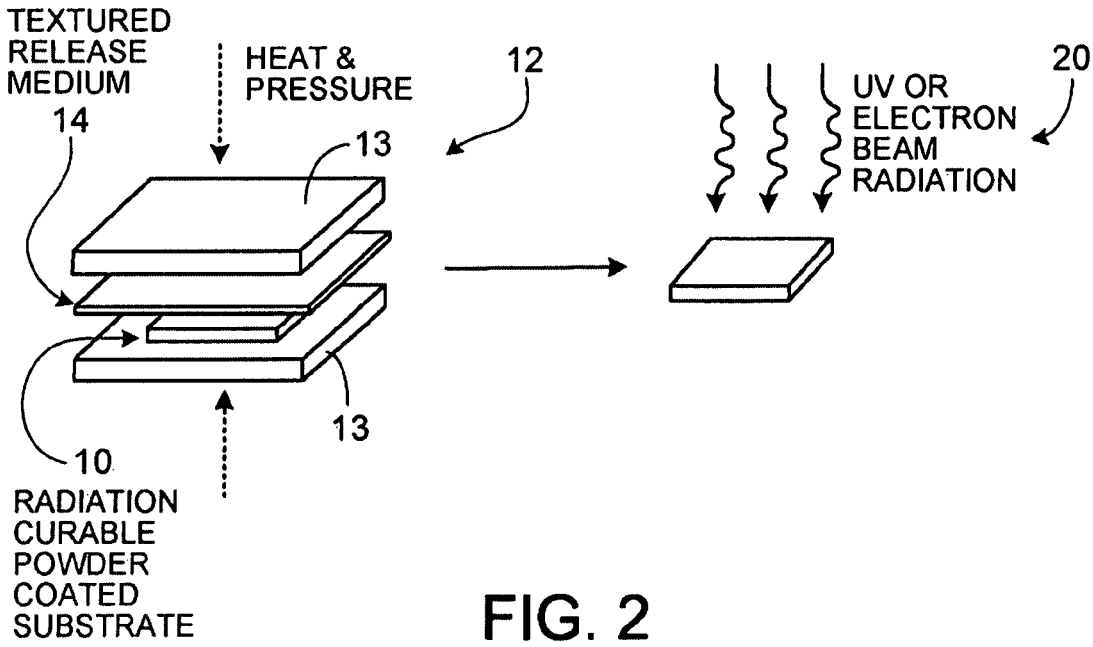
FIG. 2 is a diagrammatic view showing a texturing process according to an alternate embodiment in which the powder coating is radiation cured after being removed from the press.

In an alternative process, shown in FIG. 2, the coating is not cured in the press. Instead, the texture is imparted to the coating in the press, and the coating is cured outside of the press in a separate process step. For example, the coating may be radiation curable, and radiation may be applied in a curing station 20. The radiation may be, for example, UV or electron beam radiation. In this implementation, the texture is again imparted by application of heat and pressure in the press. However, since it is not necessary to cure the coating in the press, lower temperatures may be used, for example less than 300° F., e.g., 200 to 280° F. Advantageously, in some implementations the lower temperatures allow the release medium to be re-used more times. Moreover, temperature-sensitive substrates may be powder coated using this process.

Because the coating is not cured, the coating should generally be cooled or allowed to cool prior to stripping the release medium from the coating. The release medium may be stripped prior to curing, or, if the radiation being used can pass through the release medium, may be stripped after curing.

Figure 3:
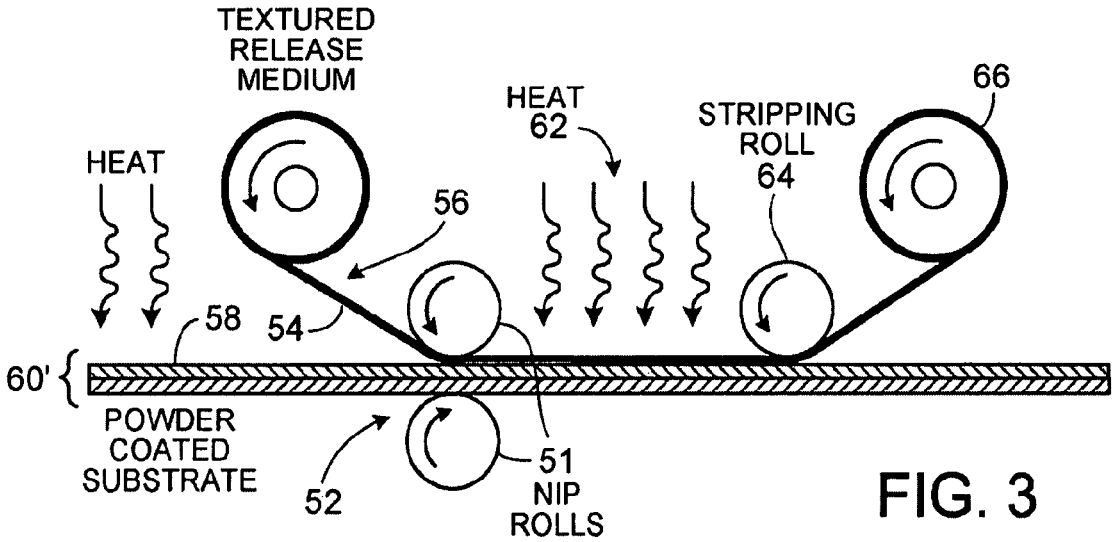
FIG. 3 is a diagrammatic view showing a process for texturing a thermally cured powder coating, using a lamination nip and a release medium in the form of a continuous web.

In another alternative process, shown in FIG. 3, a lamination nip 52 is used to provide the necessary force to impart texture from a textured surface 54 of a release medium 56 into an uncured powder coating 58 on a powder coated substrate 60. The textured release medium is fed into the lamination nip along with the powder coated substrate, which has been previously heated to allow the powder to melt, soften or partially cure. Thermally curable powder coatings will be held at an elevated temperature (between 100-400 C.) for an amount of time specific to the powder coating, in order to partially cure the coating and increase the viscosity prior to feeding the substrate through the nip. After feeding the heated powder coated substrate through the nip with the release medium, the powder coating may be heated at a heating station 62 for a certain amount of time specific to the powder coating chemistry to achieve adequate cure/polymerization. Finally, the release medium is stripped from the cured powder coating, e.g., using a stripping roll 64 and a take-up roll 66 as shown.

Figure 4:
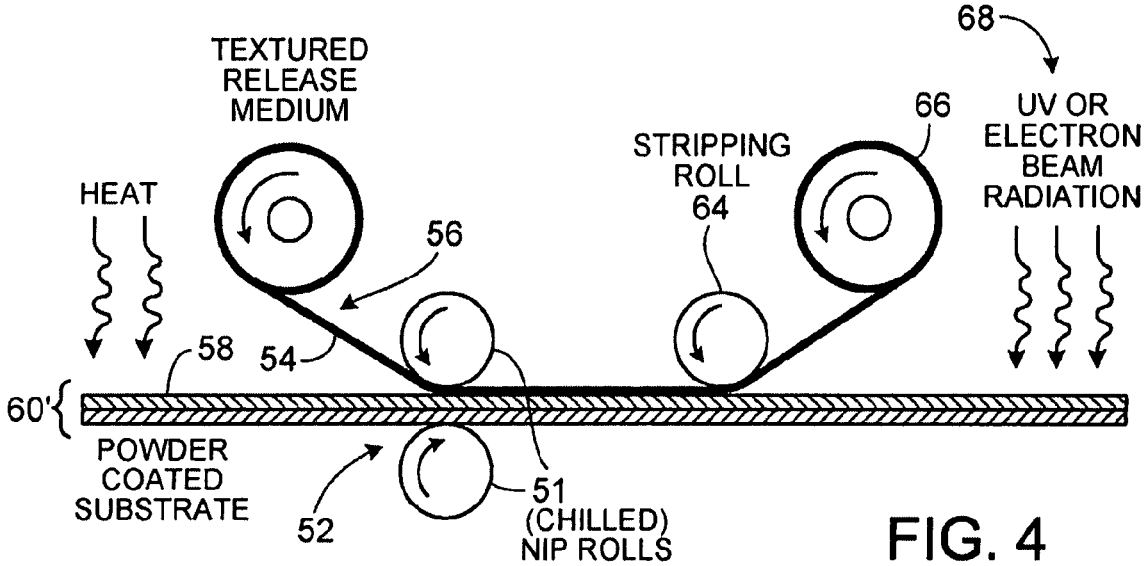
FIG. 4 is a diagrammatic view showing a texturing process similar to that shown in FIG. 3, except that the powder coating is radiation cured and exposure to radiation occurs after the release medium has been stripped.
Figure 5:
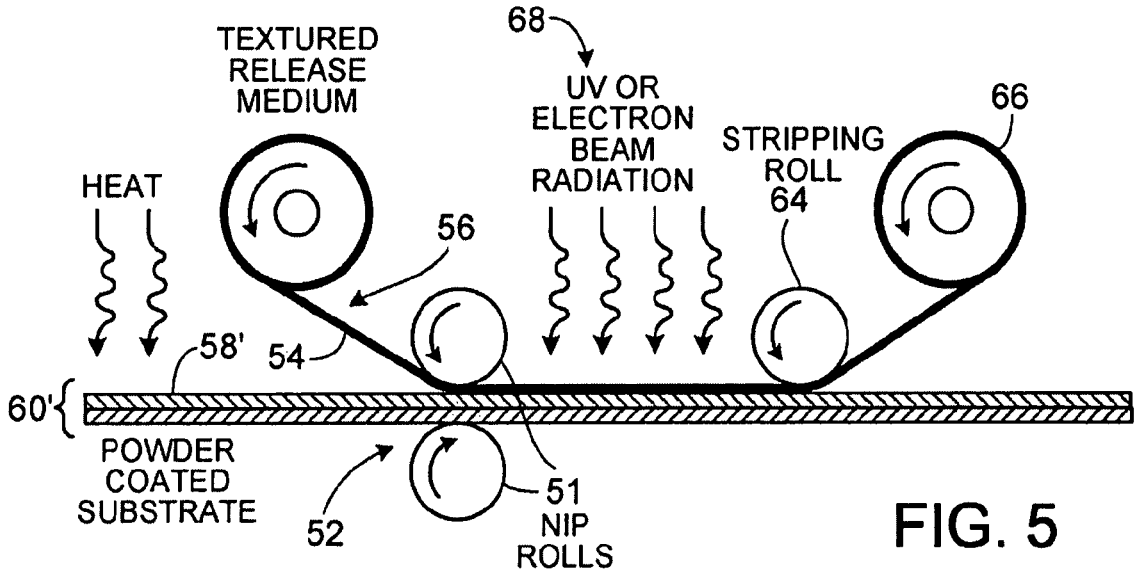
FIG. 5 is a diagrammatic view showing a texturing process similar to that shown in FIG. 4, except that exposure to radiation occurs while the release medium is in direct contact with the powder coating.

In the case of radiation curable powder coatings 58', a powder coated substrate 60' will be heated to a temperature that induces melting and then fed through the nip 52 with the release medium 56. The nip rolls 51 may be chilled if exposure to radiation 68 (UV or electron beam) does not occur until after the release medium is stripped from the powder coated substrate, as shown in FIG. 4. The chilled nip rolls 51 serve to rapidly cool and solidify the powder coating so that the texture imparted from the release medium is maintained after stripping. Alternatively, the exposure to radiation can occur before stripping, as shown in FIG. 5. In this case, the use of chilled nip rolls is optional since the curing of the radiation curable powder coating can occur in the solid or liquid state. If the release medium consists of a release paper or other material that is opaque to UV radiation, an electron beam should be used to initiate the curing/polymerization of the radiation curable powder coating. If the release medium is transparent, e.g., a transparent release film, the construction can be irradiated with either UV light or an electron beam.

Powder coatings with inherently low surface energies can provide the cured, powder coated article with release functionality. Low surface energy powders including polyolefins, acrylics, silicones, and fluoropolymers can be used as release coatings. One application features a caul plate, comprising a caul plate body having a replicative surface on one or both sides of the plate body. A textured, powder coated surface with release functionality can be created on the caul plate, to form the replicative surface, by using polyolefin, acrylic, silicone and/or fluoropolymer powder chemistries in the process described in FIG. 1. An example of a suitable low surface energy powder coating is as follows:

70 parts fluorinated polyolefin
28.9 parts pigment
0.5 part Benzoin (degassing agent)
0.5 part Modaflow (leveling agent)
0.1 part Tridecyl Phosphite (oxidation stabilizer).

Low surface energy powder coatings are commercially available, for example from General Plastics Corp., Bloomfield, N.J., under the tradename GENCOTE® 519-FEP, and from DuPont under the tradename TEFLON® ETFE. GENCOTE® 519-FEP coating includes a copolymer of tetrafluoroethylene and hexafluoropropylene that is completely fluorinated.

When it is not necessary for the cured powder coating to have release functionality, suitable powder coatings for use in the above processes include polyamide, polyester, urethane, acrylic, polyolefin, fluoropolymer and epoxy chemistries such as those that are commercially available from Dupont, Sherwin-Williams, Rohm and Haas, Protech, and others. Other powder coatings may be used, with the press conditions (time, temperature and pressure) or radiation parameters being adjusted to the curing requirements of the particular powder coating formulation. The powder coating may be clear or colored. The final powder coating properties, such as chemical resistance and release functionality of the cured coating, can be tailored through proper selection of the powder coating chemistry.

A wide variety of substrates may be used in the processes described above. For example, the substrate may be a metal, such as aluminum, steel or other metals, a cellulosic material, such as wood, fiberboard or paper, or any other material that can withstand the pressing process and to which the powder coating will adhere.

In some implementations, the release medium 14 is formed by a method that includes coating a curable liquid onto a substrate, imparting a pattern to the coating, e.g., by a mold roll, curing the coating, and stripping the substrate and cured coating from the pattern-imparting surface.

Figure 7:
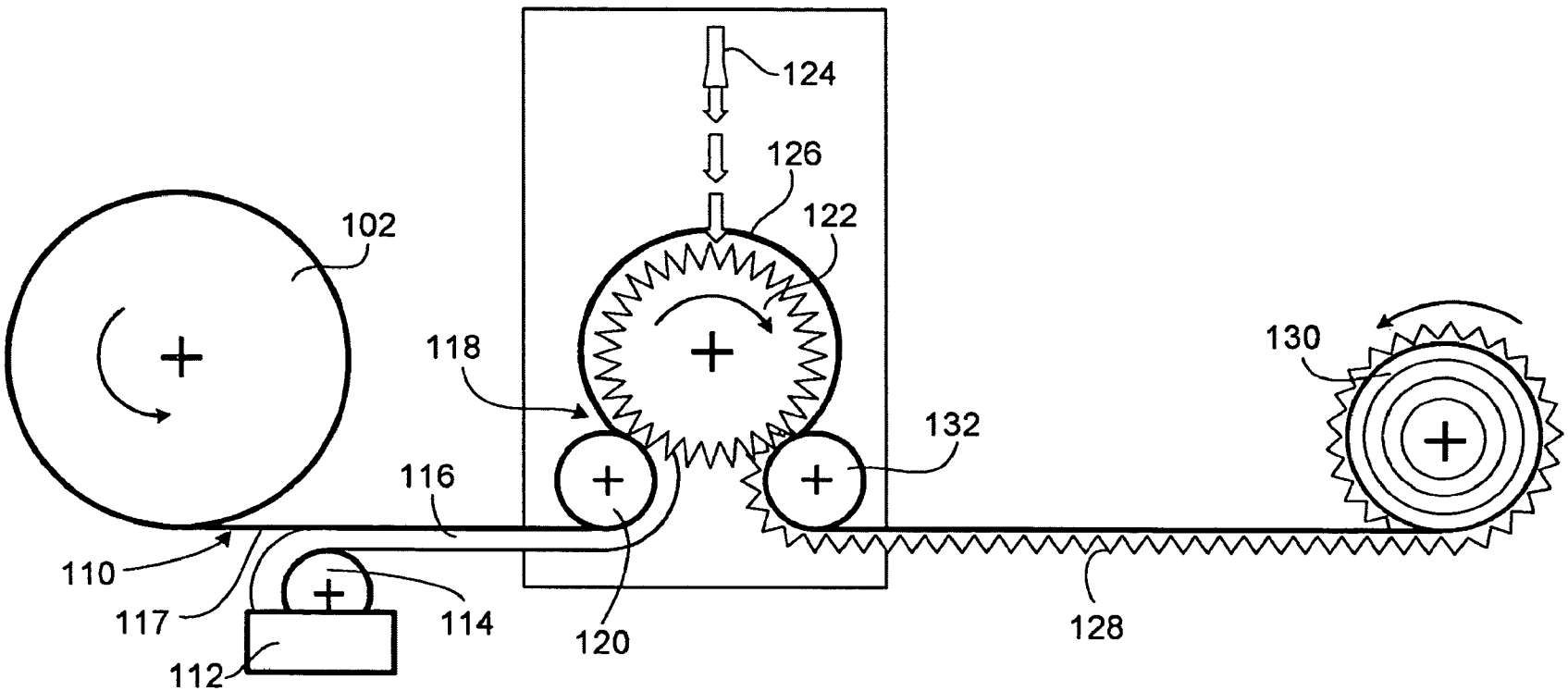
FIG. 7 is a diagrammatic view of a method of forming the release medium.

Preferably, the entire process for forming the release medium using an engraved roll is conducted on a continuous web of material which is drawn through a series of processing stations, e.g., as shown diagrammatically in FIG. 7. The process illustrated in FIG. 7 will result in very high fidelity, e.g., substantially 100% fidelity, replication of the desired pattern, which will be perpetuated in the products manufactured using the release medium.

Referring to FIG. 7, in one process a web 110, e.g., a polymeric film, first passes from a supply roll 102 to a coating station 112 at which a coating head 114 applies a wet coating 116 to a surface 117 of the web. Next, the coated web passes through a nip 118 between a backing roll 120 and an engraved roll 122, with the wet coating 116 facing the engraved roll 122. The engraved roll carries a pattern on its surface, the inverse of which is imparted to the wet coating. Nip pressure is generally relatively low (e.g., "kiss" pressure), with the nip pressure being selected based on the viscosity of the coating to prevent the coating from being squeezed off of the web, while still allowing the engraved texture to be imparted to the coating. Typically, higher viscosity coatings and deeper patterns will require relatively higher nip pressures.

After leaving the nip, the coated and textured web passes through a curing station 124, e.g., an electron beam or UV curing device. The coating is cured while it is still in contact with the surface of the engraved roll. Electron beam energy or actinic radiation is generally applied from the back surface 126 of the web and passes through the web and cures the coating 116 to form a hardened but flexible textured coating 128 that is firmly adhered to the web 110. The web 110 and cured coating 128 may be stripped off the engraved roll at take-off roll 132 and wound up on a take-up roll 130. If UV curing is used, the web should be transparent or translucent if curing is to be performed from the back surface of the web as shown.

The coating 116 may be applied using any suitable method. Suitable techniques include offset gravure, direct gravure, knife over roll, curtain coating, and other printing and coating techniques.

The engraved roll is one example of a replicative surface that may be used to impart the pattern to the wet coating. Other types of pattern-imparting devices may be used. It is generally preferred, however, that the replicative surface be disposed on a rotating endless surface such as a roll, drum, or other cylindrical surface. The coating can be applied directly to the web, before the substrate contacts the roll, as shown in FIG. 3, or alternatively the coating can be applied directly to the roll, in which case the substrate is pressed against the coated roll.

The coating may be cured by thermal curing, or preferably by radiation curing (e.g., electron beam radiation or UV radiation). Electron beam radiation is preferred in some cases because it can penetrate the thick coatings required for certain desired patterns. Electron beam radiation units are readily available and typically consist of a transformer capable of stepping up line voltage and an electron accelerator. Manufacturers of electron beam radiation units include Energy Sciences, Inc., Wilmington, Mass., and PCT Engineered Systems, LLC, Davenport, Iowa. Suitable UV curing devices are commonly available, e.g., from Fusion, Inc., Gaithersburg, Md.

The curable coatings referred to above preferably include an acrylated oligomer, a monofunctional monomer, and a multifunctional monomer for crosslinking. If ultraviolet radiation is used to cure the acrylic functional coating, the coating will also include a photoinitiator as is well known in the art. Preferred acrylated oligomers include acrylated urethanes, epoxies, polyesters, acrylics and silicones. The oligomer contributes substantially to the final properties of the coating. Practitioners skilled in the art are aware of how to select the appropriate oligomer(s) to achieve the desired final properties. Desired final properties for the release webs described herein typically require an oligomer which provides flexibility and durability. A wide range of acrylated oligomers are commercially available from Cytec Surface Specialties Corporation, such as Ebecryl 6700, 4827, 3200, 1701, and 80, and Sartomer Company, Inc., such as CN-120, CN-999 and CN-2920.

Typical monofunctional monomers include acrylic acid, N-vinylpyrrolidone, (ethoxyethoxy)ethyl acrylate, or isodecyl acrylate. Preferably the monofunctional monomer is isodecyl acrylate. The monofunctional monomer acts as a diluent, i.e., lowers the viscosity of the coating, and increases flexibility of the coating. Examples of monofunctional monomers include SR-395 and SR-440, available from Sartomer Company, Inc., and Ebecryl 111 and ODA-N (octyl/decyl acrylate), available from Cytec Surface Specialties Corporation.

Commonly used multifunctional monomers for crosslinking purposes are trimethlylolpropane triacrylate (TMPTA), propoxylated glycerl triacrylate (PGTA), tripropylene glycol diacrylate (TPGDA), and dipropylene glycol diacrylate (DPGDA). Preferably the multifunctional monomer is selected from a group consisting of TMPTA, TPGDA, and mixtures thereof. The preferred multifunctional monomer acts as a crosslinker. Examples of multifunctional monomers include SR-9020, SR-351, SR-9003 and SR-9209, manufactured by Sartomer Company, Inc., and TMPTA-N, OTA-480 and DPGDA, manufactured by Cytec Surface Specialties Corporation.

Preferably, the coating comprises, before curing, 20-50% of the acrylated oligomer, 15-35% of the monofunctional monomer, and 20-50% of the multifunctional monomer. The formulation of the coating will depend on the final targeted viscosity and the desired physical properties of the cured coating. In some implementations, the preferred viscosity is 0.2 to 5 Pascal seconds, more preferably 0.3 to 1 Pascal seconds, measured at room temperature (21-24° C.).

The coating composition may also include other ingredients such as opacifying agents, colorants, slip/spread agents and anti-static or anti-abrasive additives. The opacity of the coating may be varied, for example by the addition of various pigments such as titanium dioxide, barium sulfate and calcium carbonate, addition of hollow or solid glass beads, or addition of an incompatible liquid such as water. The degree of opacity can be adjusted by varying the amount of the additive used.

As mentioned above, a photoinitiator or photoinitiator package may be included if the coating is to be UV cured. A suitable photoinitiator is available from the Sartomer. Company under the tradename KTO-46™. The photoinitiator may be included at a level of, for example, 0.5-2%.

The substrate for the release medium may be, for example, a polymeric film or a paper or other web material.

Other methods may be used to provide the release medium. For example, the release medium may be formed using traditional embossing techniques.

A number of embodiments of the invention have been described. Nevertheless, it will be understood that various modifications may be made without departing from the spirit and scope of the invention.

Figure 8A:
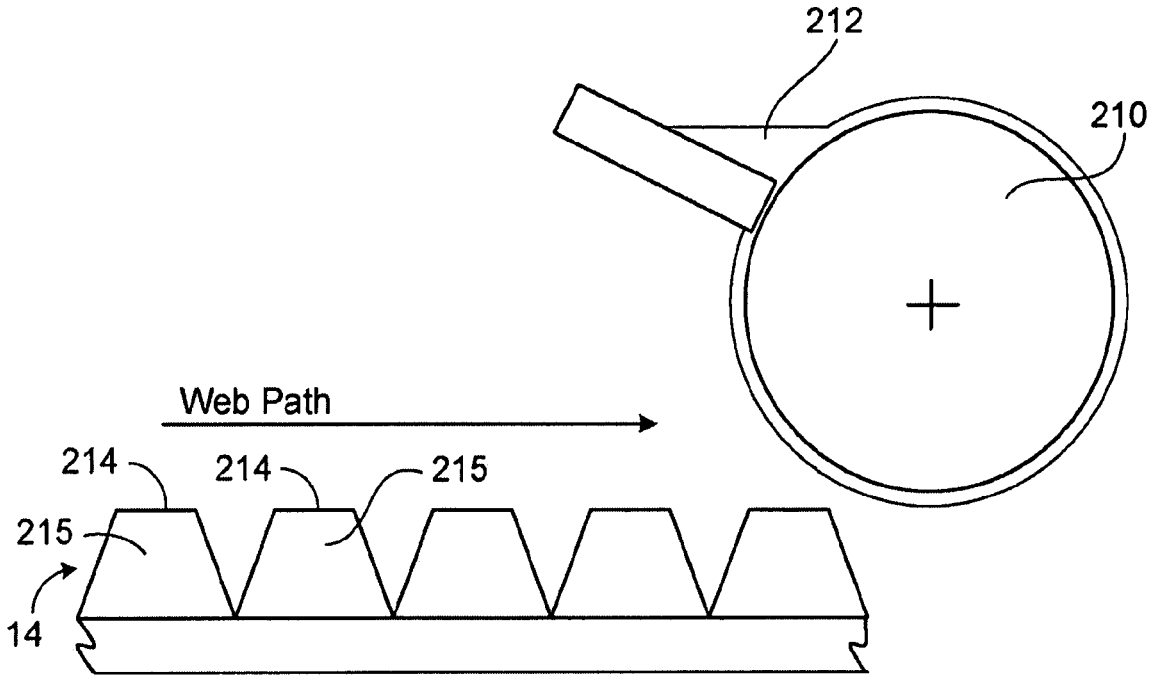
FIGS. 8A and 8B are diagrammatic views showing a tip printing process.
Figure 8B:
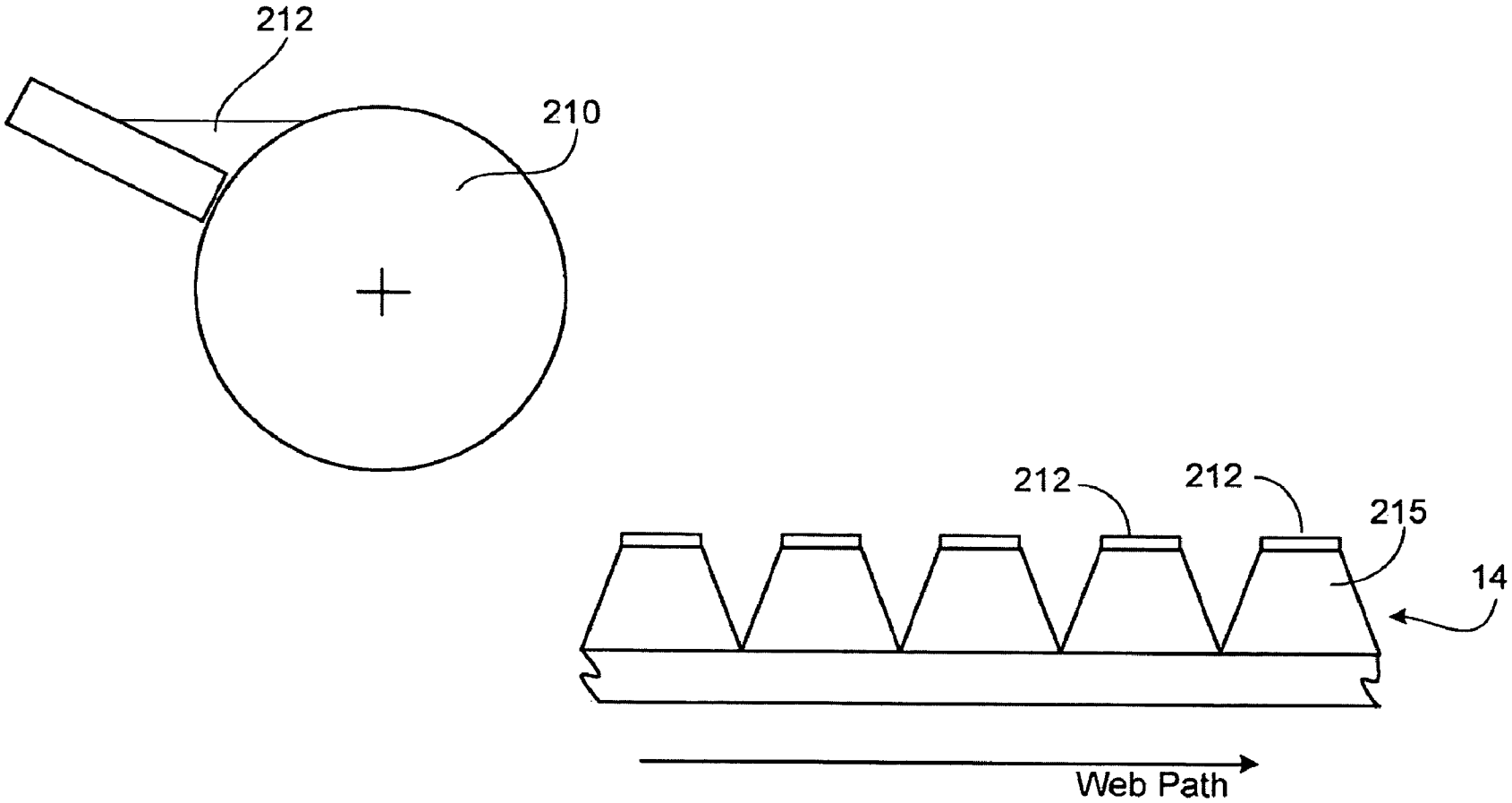

For example, if desired, the release medium may be tip printed with an ink or other coating, which will transfer to the surface of the powder coating. Tip printing is described in U.S. Ser. No. 11/670,627, filed Feb. 2, 2007, the complete disclosure of which is incorporated by reference herein. Referring to FIGS. 8A and 8B, a printing roll 210 is used to apply a printing ink 212 to the raised surfaces 214 of the "hills" 215 of the release medium 14. Because a tip printing technique is used, only the raised surfaces 14 are coated with ink, with the "valleys" or recessed areas of the embossed pattern remaining free of ink. Generally, tip printing is accomplished by moving the embossed release medium past the printing roll. Tip printing may be performed using any suitable printing technique, e.g., gravure, flexo, offset, rotary, and other well known printing techniques.

Moreover, if desired, the uncured powder coating can be applied to the substrate and melted or partially cured and then the coated substrate can be stored or transported to a remote location (e.g., a different processing facility) prior to the texture being imparted to the powder coating. The texture can then be imparted in a separate step at a later time and/or different location, and the textured coating can then either be immediately cured or can again be stored and/or shipped prior to curing. If desired, coating of the substrate, texturing of the coating, and curing of the textured coating may take place at three separate locations.

Figure 6:
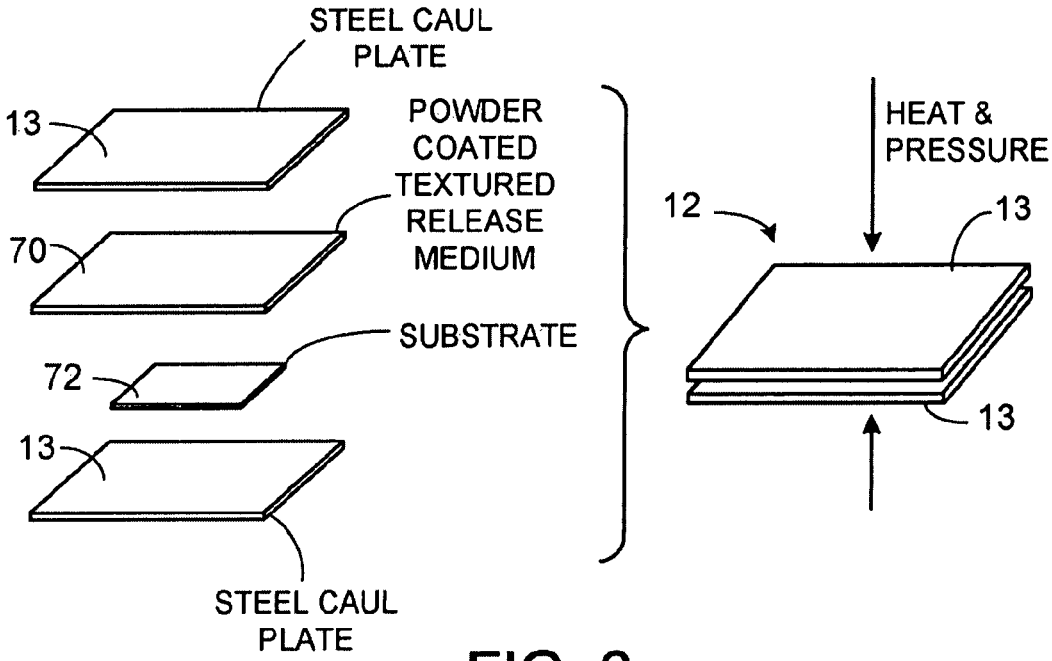
FIG. 6 is a diagrammatic view showing a process for transferring a powder coating from a release medium surface in a press.

In another alternative embodiment, the release medium may act as a powder coating carrier which is used to transfer an uncured powder coating from the release medium to a substrate. In some implementations, the release medium is textured, so as to impart a surface texture to the powder coating. Referring to FIG. 6, the release medium first is powder coated and the powder coating formulation is heated to a temperature which melts the powder coating to form a uniform coating without initiating any significant amount of curing. It is important that the temperature stay below the curing temperature for a thermoset powder coating so as to minimize the extent of cure which takes place prior to transferring the powder coating from the release medium. Once the powder coated release medium 70 is cooled, the construction can be freely handled and stored for later use. To transfer the powder coating from the release medium to a substrate 72, the same procedure illustrated in FIG. 1 is followed; however, in this case the release medium 70 has the powder coating on its textured surface and the substrate 72 initially has no powder coating.

Accordingly, other embodiments are within the scope of the following claims.

What is claimed is:

1. A method of powder coating a substrate comprising:

providing a release medium bearing a replicative surface comprising a release medium substrate and a textured coating layer, the textured coating layer comprising a cured mixture of acrylated oligomers, monofunctional monomers, and multifunctional monomers;

applying an uncured powder coating formulation to a substrate to be powder coated to form an uncured powder coating layer;

imparting a texture to the uncured powder coating layer by contacting the uncured powder coating layer with the release medium bearing a replicative surface and applying pressure;

curing the powder coating layer; and stripping the release medium bearing a replicative surface from the textured powder coated layer.

2. The method of claim 1 wherein the texture is imparted to the uncured powder coating layer in a press.

3. The method of claim 1 wherein the powder coating layer is thermally cured.

4. The method of claim 3 wherein the texture is imparted and the powder coating layer is cured in a press.

5. The method of claim 1 wherein the powder coating layer is radiation cured.

6. The method of claim 5 wherein the texture is imparted in a press, the textured powder coated substrate is removed from the press, and the textured powder coating layer is cured at a radiation curing station.

7. The method of claim 6 wherein the release medium bearing a replicative surface is stripped from the textured powder coating layer prior to curing.

8. The method of claim 1 wherein the substrate of the release medium bearing a replicative surface comprises a release film or release paper.

9. The method of claim 8 wherein providing the release medium bearing a replicative surface comprises applying a curable mixture of acrylated oligomers, monofunctional monomers, and multifunctional monomers to a flexible web, imparting a texture to the curable mixture and curing the curable mixture to form the textured coating layer.

10. The method of claim 9 wherein the texture is imparted to the curable mixture on the flexible web using a roll engraved with a replicative pattern.

11. The method of claim 2 wherein the pressure applied by the press is 5 to 700 psi.

12. The method of claim 1 further comprising tip printing the textured coating layer of the release medium prior to imparting the texture to the uncured powder coating.

13. The method of claim 1 wherein the release medium substrate is in the form of a sheet.

14. The method of claim 1 wherein the release medium substrate is in the form of a web.

15. A method of powder coating a substrate comprising:

providing a release medium bearing a replicative surface comprising a release medium substrate and a textured coating layer, the textured coating layer comprising a cured mixture of acrylated oligomers, monofunctional monomers, and multifunctional monomers;

applying an uncured powder coating formulation to the release medium bearing a replicative surface;

contacting an exposed surface of the uncured powder coating formulation with a substrate to be powder coated, applying sufficient pressure so that the uncured powder coating formulation adheres to the substrate;

curing the powder coating formulation; and stripping the release medium bearing a replicative surface from the cured powder coating formulation.

16. The method of claim 15 wherein the textured coating layer includes a replicative surface that is imparted to the surface of the powder coating formulation that is in contact with the release medium during curing.

17. The method of claim 15 wherein curing is conducted in a press.

18. The method of claim 15 wherein the release medium is stripped from the uncured powder coating formulation adhered to the substrate to be powder coated prior to curing.

19. The method of claim 15 wherein the release medium substrate comprises a release film or release paper.

20. The method of claim 19 wherein the release medium substrate is in the form of a web.

21. The method of claim 20 wherein providing the release medium bearing a replicative surface comprises applying a curable mixture of acrylated oligomers, monofunctional monomers, and multifunctional monomers to a flexible web, imparting a texture to the curable mixture and curing the curable mixture to form the textured coating layer.

* * * * *

UNITED STATES PATENT AND TRADEMARK OFFICE

CERTIFICATE OF CORRECTION

PATENT NO. : 7,771,795 B2
APPLICATION NO. : 11/839163
DATED : August 10, 2010
INVENTOR(S) : David H. Juers et al.

It is certified that error appears in the above-identified patent and that said Letters Patent is hereby corrected as shown below:

In Column 6, Line 62, please delete "trimethlylolpropane" and insert
-- trimethylolpropane --, therefor In Column 6, Line 63, please delete "glycerl" and insert
-- glyceryl --, therefor In Column 7, Line 25, please delete "Sartomer." and insert
-- Sartomer --, therefor Signed and Sealed this
Twenty-eighth Day of December, 2010

David J. Kappos

David J. Kappos
*Director of the United States Patent and Trademark Office*